US005205057A

United States Patent [19]

Garman

[11] Patent Number: 5,205,057

[45] Date of Patent: Apr. 27, 1993

[54] RETAINING MECHANISM FOR A TOOTH ASSEMBLY

[75] Inventor: James A. Garman, Eureka, Ill.

[73] Assignee: Caterpillar Inc., Peoria, Ill.

[21] Appl. No.: 947,086

[22] Filed: Sep. 18, 1992

Related U.S. Application Data

[63] Continuation of Ser. No. 758,987, Sep. 10, 1991, abandoned.

[51] Int. Cl.[5] ..... E02F 9/28

[52] U.S. Cl. ..... 37/458; 37/452

[58] Field of Search ..... 37/142 A, 142 R, 141 T, 37/141 R, 103; 299/91, 92

[56] References Cited

U.S. PATENT DOCUMENTS

| | | | |
|---|---|---|---|
| 3,601,911 | 8/1971 | Wood . | |
| 3,796,464 | 3/1974 | Hansen et al. | 37/142 A X |
| 3,959,901 | 6/1976 | Klett . | |
| 4,006,661 | 2/1977 | Sims, Jr. . | |
| 4,055,223 | 10/1977 | Casey et al. | 37/141 T X |
| 4,096,653 | 6/1978 | Kaarlela | 37/142 A |
| 4,611,417 | 9/1986 | Carlson | 37/142 A X |
| 4,716,668 | 1/1988 | Hahn | 37/142 A |
| 4,848,013 | 7/1989 | Bowman et al. | 37/142 A |
| 4,881,331 | 11/1989 | Paizes | 37/142 A |
| 4,918,843 | 4/1990 | Kiesewetter et al. | 37/142 A |
| 5,009,017 | 4/1991 | Diekevers et al. . | |

*Primary Examiner*—Dennis L. Taylor
*Assistant Examiner*—J. Russell McBee
*Attorney, Agent, or Firm*—J. W. Burrows

[57] ABSTRACT

Retaining mechanisms are normally utilized for securing a tooth to an adapter. Many times the forces necessary to secure the retaining mechanism in an assembled position is not high enough to maintain assembly during use. In the subject arrangement, the retaining mechanism includes a pin having a means thereon for forming a shoulder and a plurality of conical spring washers each having an inner surface defining an opening having a diameter of a predetermined size which is smaller than the outer diameter of the shoulder means. During assembly, the shoulder means of the pin is forced through the opening of the respective conical spring washers from a concave side thereof. In order to disassemble the pin, the shoulder means of the pin must be forced through the respective openings. In instances where the pin must be removed from the same side that it is installed, a much higher force is required to force the shoulder means through the opening of the respective first, second, and third conical spring washers. Consequently, a retaining mechanism is provided which has very high resistance to inadvertent disassembly during use.

25 Claims, 3 Drawing Sheets 10
12
2
20
18
42
16
76
22
24
44
74
53
46
28
34
30
2
14
66
70
58
40
62
60
32

34
28
12
70
58
40
18
78
76
74
60
42
44
16
62
32
46
14

RETAINING MECHANISM FOR A TOOTH ASSEMBLY

This is a continuation of Ser. No. 07/758,987, filed Sep. 10, 1991, now abandoned.

TECHNICAL FIELD

This invention relates generally to a tooth assembly and more particularly to a retaining mechanism for the tooth assembly.

BACKGROUND ART

Various types of retaining mechanisms are used to retain, for example, a tooth to an adapter. When using a retaining mechanism to retain the tooth to the adapter, it is desirable to be able to readily install the retaining mechanism and have the retaining mechanism remain in its assembled position without inadvertently coming apart during use. When, during use, a retaining mechanism allows the tooth to separate from the adapter, the tooth may accidentally be loaded with the materials being worked and cause damage to the equipment that is subsequently processing the material being worked.

One typical example of a retaining mechanism used is illustrated in U.S. Pat. No. 3,959,901, which issued Jun. 1, 1976 to G. R. Klett. This arrangement teaches a pin that is inserted through corresponding holes of a tooth and adapter and a split spring washer that is inserted in a counterbored hole in the adapter and the pin is forced to slide through the split spring washer. The clamping force of the split spring washer on the pin maintains the pin in its assembled position. In this arrangement, the force necessary to install the pin is generally equal to or greater than the force required to disassemble the retaining mechanism. Furthermore, the retaining force is only as strong as the clamping force exerted by the split spring washer. Another example is illustrated in U.S. Pat. No. 3,601,911, which issued Aug. 31, 1971 to D. L. Wood. This arrangement is similar to the previous noted arrangement, except this arrangement provides two separate pins, one extending from each side, and having a groove in the pin for the split spring washer to rest. The force necessary to assemble the retaining mechanism of this arrangement appears to be generally the same as the force necessary to disassemble the retaining mechanism.

Another example is illustrated in U.S. Pat. No. 5,009,017, which issued Apr. 23, 1991 to M. S. Diekevers et al. This arrangement is similar to the above-noted arrangements in that a pin is used to hold the tip to the adapter. A washer is located in a counterbored hole of the adapter and has a split resilient retaining ring disposed in an inner surface of the washer and the pin has a grooved defined in the circumference thereof. When assembled, the split resilient retaining ring is expanded and once the groove of the pin reaches the location of the split resilient retaining ring, the retaining ring snaps into the groove to the extent that a portion of the retaining ring is in the groove and a portion thereof remains in the washer. Upon disassembly, it is necessary to apply a sufficient force to either shear the split resilient retaining ring or fracture the washer in order to allow the pin to be removed.

U.S. Pat. 4,006,661 which issued Feb. 8, 1977 to D. M. Sims, Jr. illustrates a typical use of conical spring washers. The conical washers are used to provide a continuous separating force on a mechanical connection once they have been forced towards a flattened shaped.

The present invention is directed to overcoming one or more of the problems as set forth above.

DISCLOSURE OF THE INVENTION

In one aspect of the present invention, a retaining mechanism is provided and adapted for use in securing a ground engaging tool to a work implement. The ground engaging tool has a rearward end portion defining a socket and first and second openings defined in the end portion on opposite sides of the socket. The work implement has a nose portion adapted to mate with the socket and defines a cross passage that registers, when assembled, with the aligned openings of the ground engaging tool. An annular recess having a bottom surface is defined in the nose portion or one side of the rearward end portion and is concentric with the cross passage or the aligned openings. The retaining mechanism includes a conical spring washer defining an opening having a predetermined diameter and being adapted, when assembled, to be located in the annular recess and a pin adapted, when assembled, to be located in the aligned openings, the cross passage, and the opening of the conical spring washer. The conical spring washer has a concave side, a convex side, and an inner surface. The pin has a predetermined diameter and includes means for forming a shoulder thereon. When assembled, the shoulder means is disposed in the annular recess adjacent the convex side of the conical spring washer.

In another aspect of the present invention, a tooth assembly is provided and includes a ground engaging tool, a work implement, and a retaining mechanism. The ground engaging tool has a rearward end portion defining a socket and first and second aligned openings defined therein on opposite sides of the socket. The work implement has a nose portion that is operative to mate with the socket of the ground engaging tool. A cross passage is defined in the nose portion and is generally in axial alignment with the aligned openings. An annular recess is defined in one side of the nose portion and is concentric with the cross passage. The retaining mechanism includes a conical spring washer having a concave side, a convex side, an outer peripheral edge on the convex side, and an inner surface defining an opening of a predetermined diameter, and a pin having a predetermined diameter. The pin includes means for forming a shoulder thereon. The conical spring washer is located in the annular recess and the pin is disposed in the aligned openings, the cross passage, and the conical spring washer. The shoulder means is located adjacent the convex side of the conical spring washer.

The present invention provides a retaining mechanism that can be readily assembled with a predetermined force and has a retaining force that is normally higher than the assembly force. This ensures that the pin is positively held in place during use and still allows disassembly by applying a higher force thereto than that required to assemble the retaining mechanism.

BEST MODE FOR CARRYING OUT THE INVENTION

Figure 1:
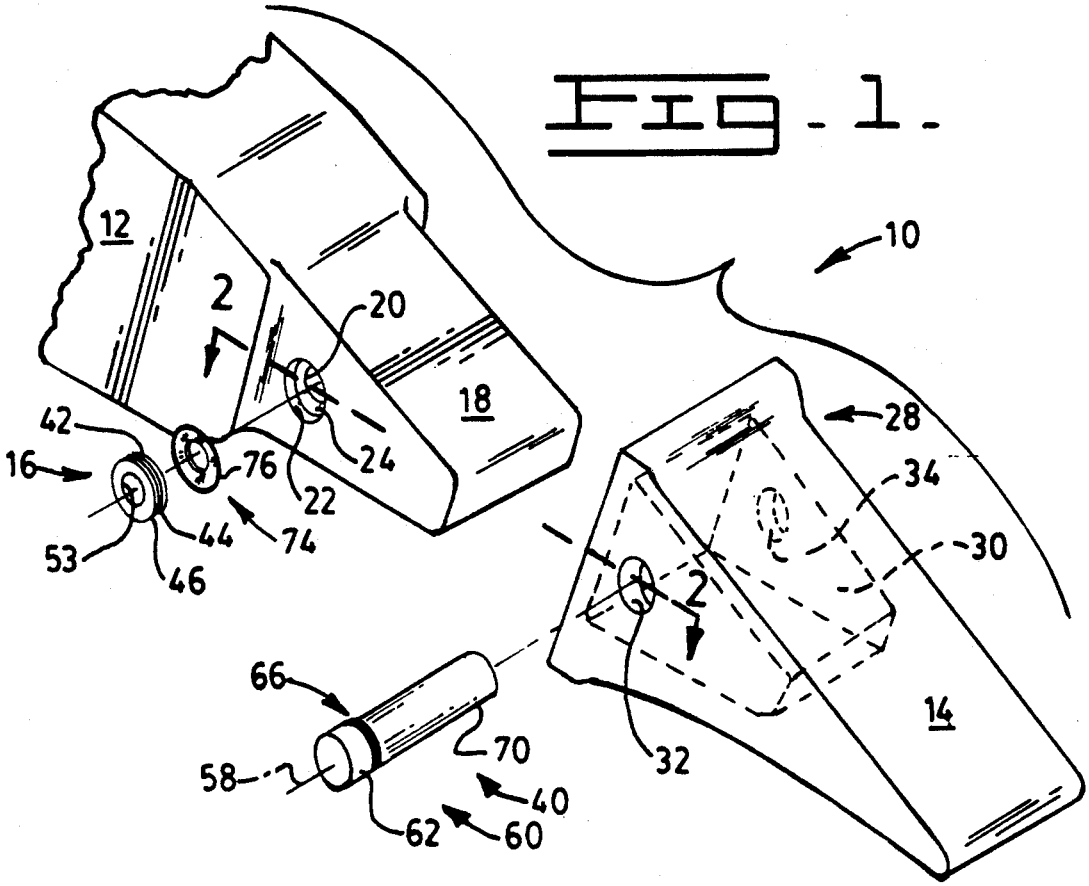
FIG. 1 is an isometric representation of a retaining mechanism for a tooth assembly incorporating an embodiment of the present invention.
Figure 2:
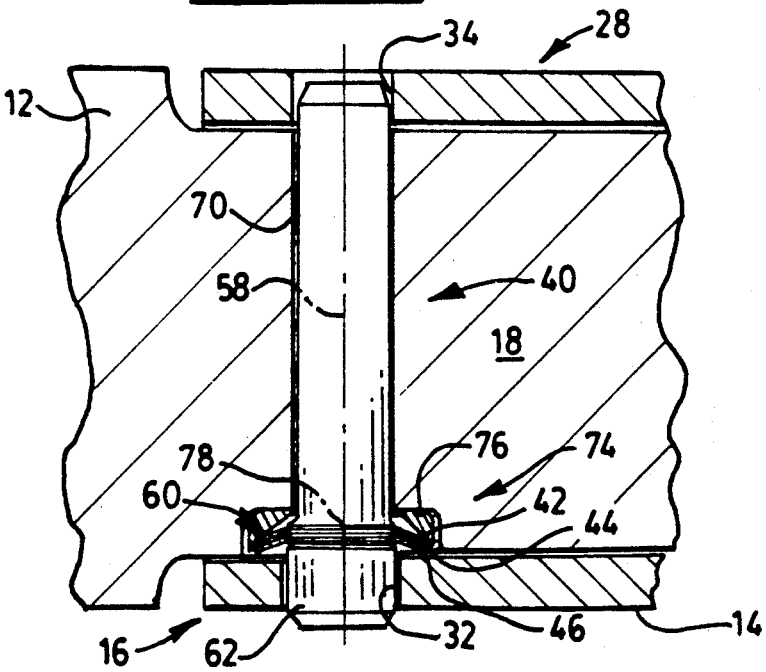
FIG. 2 is a partial cross-sectional view taken from FIG. 1 with the components of FIG. 1 being assembled.
Figure 3:
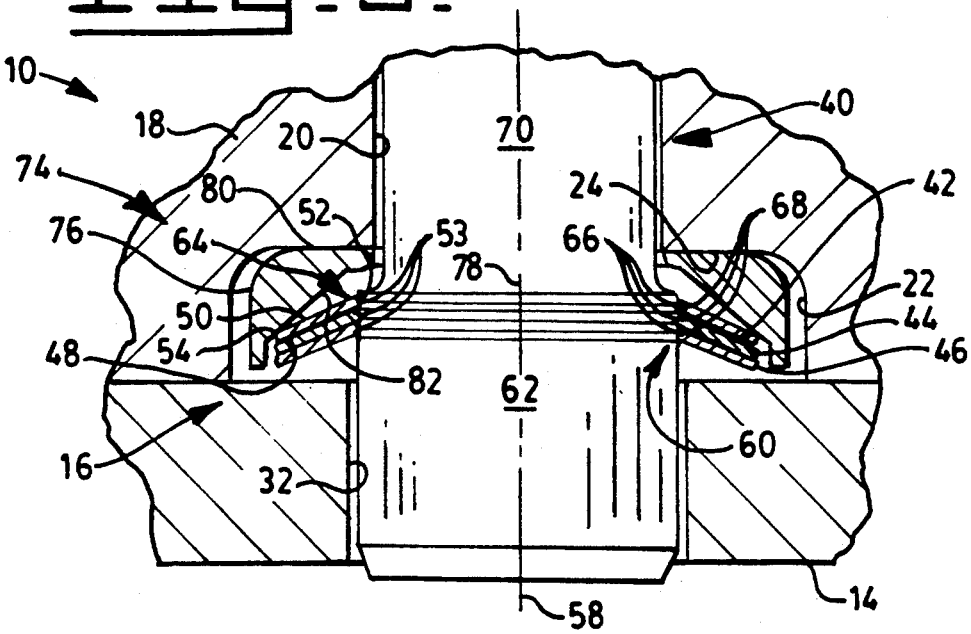
FIG. 3 is an enlarged partial cross-sectional view of the retaining mechanism of FIG. 2.

Referring to the drawings, and more particularly to FIGS. 1, 2, and 3, a tooth assembly 10 is illustrated. The tooth assembly 10 includes a work element 12, a ground engaging tool 14, and a retaining mechanism 16. The work implement 12 includes a nose portion 18 defining a cross passage 20 therein. An annular recess 22 having a bottom surface 24 is defined in the nose portion 18 and concentric with the cross passage 20.

The ground engaging tool 14 has a rearward end portion 28 operative to snugly mate with the nose portion 18 of the work implement 12. A socket 30 is defined in the rearward end portion 28 and first and second aligned openings 32,34 are defined in the rearward end portion 28 with the aligned openings 32,34 being on opposite sides of the socket 30.

The retaining mechanism 16 includes a pin 40 having a predetermined diameter and first, second, and third conical spring washers 42,44,46. The first conical spring washer has a concave side 48, a convex side 50, an inner surface 52 defining a opening 53 having a predetermined diameter and an outer peripheral edge 54 on the convex side 50 thereof. The second and third conical spring washers 44,46 are substantially identical to the first conical spring washer 42. Therefore, element numbers relating to features of the first conical spring washer 42 are the same for the second and third conical spring washers 44, 46. When assembled, each of the conical spring washers 42,44,46 is located in the annular recess 22 of the nose portion 18 and each has its convex side 50 facing towards the bottom surface 24 of the annular recess 22.

The pin 40 has a longitudinal axis 58 and includes means 60 for forming a shoulder thereon. A first portion 62 of the pin having the predetermined diameter defines a groove 64 in the circumference thereof generally adjacent one end thereof. A plurality of individual adjacent ridges 66 are located generally in the bottom of the groove 64 and the respective ridges 66 are angled relative to the longitudinal axis 58 thereof to form the respective shoulders 68. The outer diameter of the respective shoulders 68 is greater than diameter of the opening 53 defined by the inner surface 52 of each of the first, second, and third conical spring washers 42,44,46.

A second portion 70 of the pin 40 has a diameter smaller than the opening 53 of the first, second, and third conical spring washer 42,44,46, and is operative, when assembled, to be disposed in the cross passage 20 and the second aligned opening 34. The first portion 62 of the pin 40, when assembled, is located in the first aligned opening 32 and the annular recess 22. The diameter of the cross passage 20 is smaller than the diameter of the first portion 62 of the pin 40. When assembled, the convex side of the first, second, and third conical spring washers 42,44,46 faces the second portion 70 of the pin 40.

A means 74 for supporting the first conical spring washer 42 is provided and located in the annular recess 22 of the nose portion 18. The supporting means 74 includes a hollow support member 76. The hollow support member 76 has a longitudinal axis 78 which is generally parallel to the longitudinal axis 58 of the pin 40. A first surface 80 is provided on the support member 76 and is perpendicular to the longitudinal axis 78. A second surface 82 is provided on the hollow support member 76 and is angled with respect to the longitudinal axis 78 at generally a 45 degree angle. The hollow support member 76 is located in the annular recess 22 with the first surface 80 of the hollow support member 76 being in contact with the bottom surface 24 of the annular recess 22. During assembly, the angled second surface 82 is engaged by and supports the outer peripheral edge 54 of the first conical spring washer 42.

Figure 4:
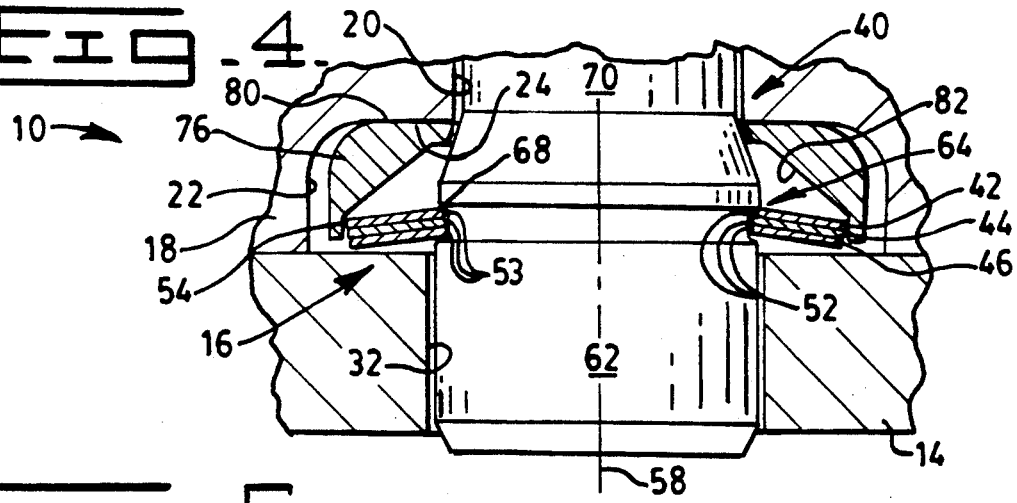
FIG. 4 is a partial sectional view similar to FIG. 3 but representing another embodiment of the present invention.

Referring now to FIG. 4, another embodiment of the subject invention is illustrated. The embodiment of FIG. 4 is substantially the same as the embodiment of FIG. 3 and like elements have the same reference numerals. The groove 64 of FIG. 4 has a diameter that is smaller than the diameter of the opening 53 of the first, second, and third conical spring washers 42,44,46. The width of the groove 64 is sufficient to receive the first, second, and third conical spring washers 42,44,46. The shoulder 68 in the subject embodiment is formed by one side of the groove 64. The outer diameter of the shoulder 68 is the same as the predetermined diameter of the first portion 62 of the pin 40. The remainder of the embodiment of FIG. 4 is the same as that illustrated in FIGS. 1-3.

Figure 5:
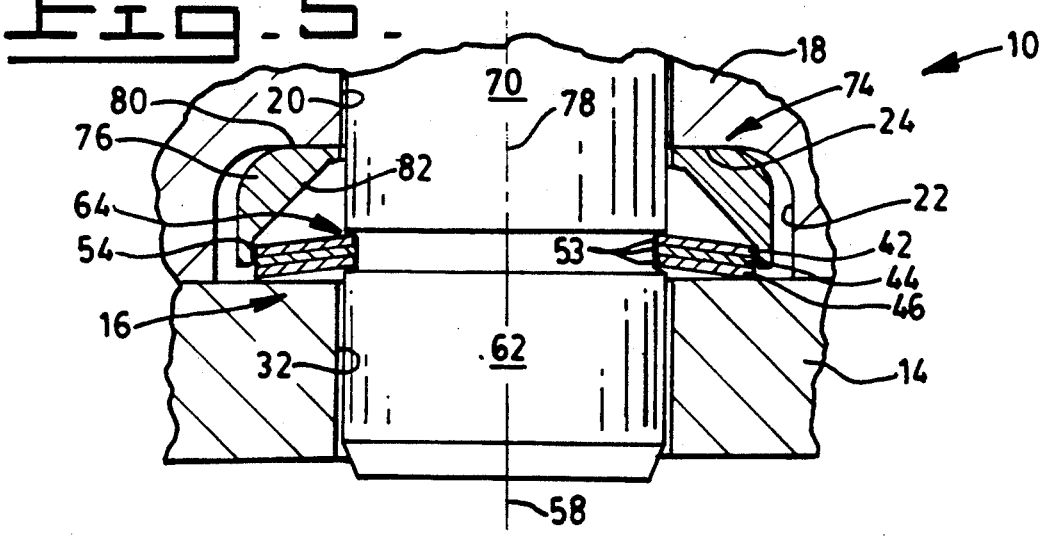
FIG. 5 is a partial cross-sectional view similar to FIG. 3 above but representing another embodiment of the present invention.

Referring to FIG. 5, another embodiment of the present invention is illustrated. In the subject arrangement of FIG. 5, the first portion 62 and the second portion 70 of the pin 40 are both of the same size and both have the same predetermined diameter. Furthermore, the first and second aligned openings 32,34 are of the same size sufficient for the pin 40 to pass therethrough. The features of the groove 64 of the subject embodiment are the same as that set forth in FIG. 4. Likewise, the shoulder 68 is formed in the same manner as the shoulder 68 of FIG. 4. In order for the first portion 62 and the second portion 70 to have the same predetermined diameter, the cross passage 20 and the second aligned opening 34 are increased in size to be generally the same as the first aligned opening 32. The remaining components are the same as those set forth in the previous embodiments.

Figure 6:
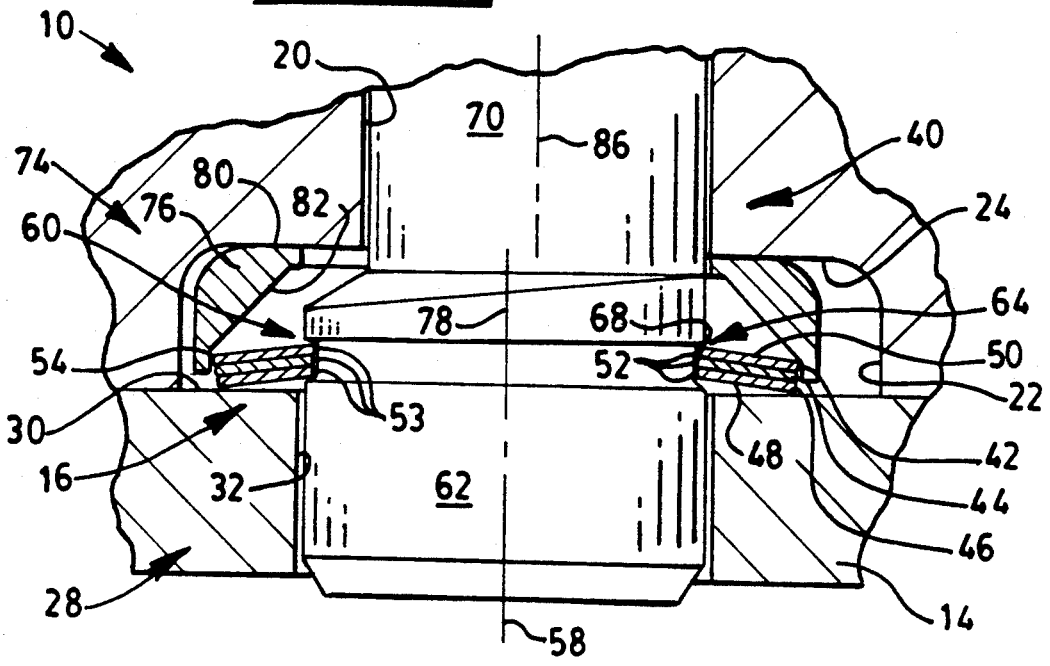
FIG. 6 is a partial cross-sectional view similar to FIG. 3 above but representing another embodiment of the present invention.

Referring now to FIG. 6, another embodiment of the present invention is illustrated. In the arrangement of FIG. 6, most of the elements are identical to those set forth in the previous embodiments. The pin 40 of FIG. 6 is an offset pin. More specifically, a second longitudinal axis 86 is defined in the second portion 70 and is offset from the longitudinal axis 58 of the first portion 62. The longitudinal axis 86 is parallel with the longitudinal axis 58. The degree of offset between the first longitudinal axis 58 of the first portion 62 and the second longitudinal axis 86 of the second portion 70 is sufficient to insure that the first and second portions 62,70 are in a common plane along a portion of the respective circumferences thereof. The cross passage 20 and the second aligned opening 34 are smaller in cross-section than the first portion 62. Naturally, the first aligned opening 32 is larger than the first portion 62. The groove 64 is the same as that previously set forth with respect to FIGS. 4 and 5 and the shoulder 68 is formed in the same manner.

Figure 7:
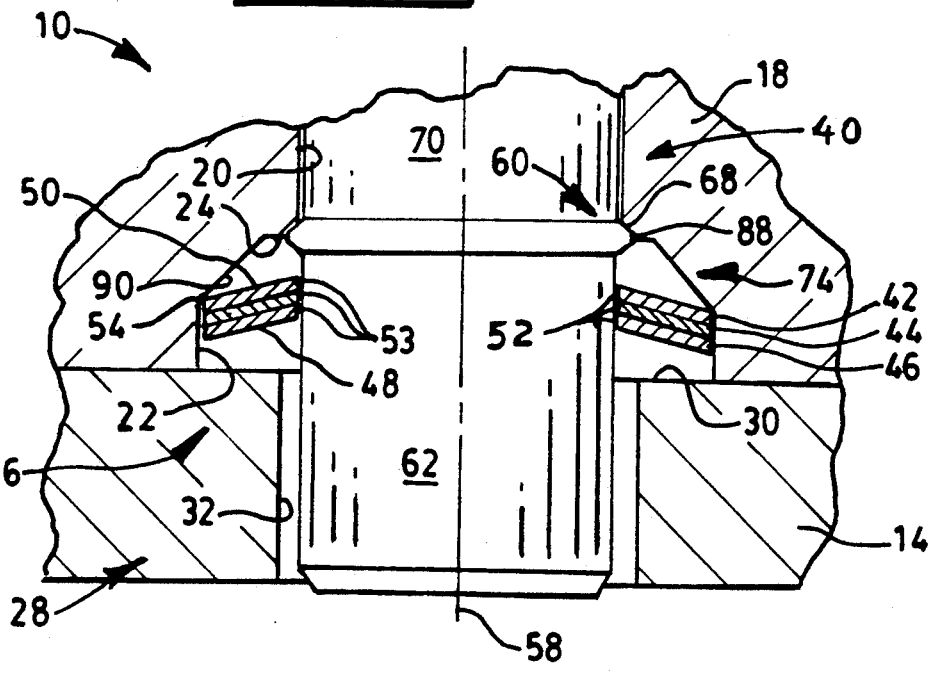
FIG. 7 is a partial cross-sectional view similar to FIG. 3 above but representing another embodiment of the present invention.

Referring to FIG. 7, another embodiment of the subject invention is illustrated. In the arrangement of FIG. 7, the pin 40 has an enlarged portion 88 thereof having a diameter larger than the predetermined diameter of the pin 40. The enlarged portion 88 is located generally adjacent one end of the pin 40 thereof. The shoulder 68 is formed by the intersection of the enlarged portion 88 and the surface of the first portion 62 of the pin 40. In the subject embodiment, the enlarged portion 88 of the pin 40, when assembled, is located in the annular recess 22 between the cross passage 20 and the first conical spring washer 42. The cross passage 20 has a diameter smaller than the diameter of the first aligned opening 32 and the outer diameter of the enlarged portion 88 is smaller than the diameter of the first aligned opening 32.

In the subject arrangement of FIG. 7, the means 74 for supporting the first conical spring washer 42 during assembly is integrally formed in the annular recess 22. An angled surface 90 is formed in the bottom portion of the annular recess 22 adjacent the bottom surface 24 and at an angle of generally 45 degrees therewith. When considering the previous embodiment set forth in FIGS. 3–6, it is recognized that instead of having the hollow support member 76 located in the annular recess 22, the structure illustrated in FIG. 7 could be utilized in any one of the preceding embodiments. Likewise, the hollow support member 76 of the previous embodiments could be utilized in FIG. 7 in place of the angled surface 90 without departing from the essence of the invention.

One aspect of the present invention provides a tooth assembly 10 wherein the retaining mechanism 16 can be easily installed with a lower force while a larger force is necessary to disassemble the retaining mechanism. In all of the above-noted embodiments, there is a relationship between the diameter of the opening 53 of each of the first, second, and third conical spring washers 42,44,46, and the outer diameter of the shoulder 68 that is forced through the opening 53. Generally, the outer diameter of the shoulder 68 in each of the above-noted embodiments is two to five percent greater than the diameter of the opening 53 of the respective first, second, and third conical spring washers 42,44,46. Preferably, the outer diameter of the respective shoulders 68 is three to four percent greater than the diameter of the opening 53.

Even though the cross passage 20 and the aligned openings 32,34 have been indicated as having diameters, it is recognized that their shapes could be varied without departing from the essence of the invention.

INDUSTRIAL APPLICABILITY

In order to assemble the tooth assembly 10 as illustrated in FIGS. 1–6, the hollow support member 76 is placed in the annular recess 22 with the first surface 80 thereof being placed in abutment with the bottom surface 24 of the annular recess 20. The first, second, and third conical spring washers 42,44,46 are then placed in the annular recess adjacent the hollow support member 76. Each of the first, second, and third conical spring washers 42,44,46 are placed adjacent each other with the convex side of each facing towards the hollow support member 76. The socket 30 of the ground engaging tool 14 is slipped over the nose portion 18 until the first and second aligned openings 32,34 are in alignment with the cross passage 20 and the annular recess 22. The second portion 70 of the pin 40 is inserted into the first aligned passage 32 through the first, second, and third conical spring washers 42,44,46 and into the cross passage 20 until the larger first portion 62 of the pin 40 contacts the concave side 48 of the third conical spring washer 46. An external force is applied to the exposed end of the first portion 62 of the pin 40 forcing each of the first, second, and third conical spring washers 42,44,46 to flex. Since the outer peripheral edge 54 of the first conical spring washer 42 is in contact with the angled second surface 82 of the hollow support member 76 and the external force is being transmitted to the concave side 48 of the third conical washer 46, the first, second, and third conical spring washers 42,44,46 are forced to flex. The flexing of the respective first, second, and third conical spring washers 42,44,46 results in a shape that is more convex. Simultaneously with the flexing of the first, second, and third conical spring washers 42,44,46, the diameter of the respective openings 53 thereof is enlarged allowing the inner surface 52 to slip over the respective shoulders 68 of the plurality of ridges 66. The external force is continuously applied to the pin 40 until the inner surface 52 of each of the first, second, and third conical spring washers 42,44,46 is located in abutment with the respective angled ridges 66 of the groove 64. At this point, the pin 40 is fully assembled and the second portion 70 has extended into the second aligned opening 34. Once the external force is withdrawn, the first, second, and third conical spring washers 42,44,46 attempt to return to their original shape. In the subject embodiment, best illustrated in FIG. 3, the inner surface 52 of each of the first, second, and third conical spring washers 42,44,46 are tightly pressed against the respective ridges 66 thereof. However, it should be recognized that the diameter of the angled ridges 66 could be such that the first, second, and third conical spring washers 42,44,46 could return to their original shape and not be tightly pressed against the ridges 66 without departing from the essence of the invention.

Since the first portion 62 of the pin 40 has a diameter greater than the diameter of the cross passage 20, the first portion 70 of the pin 40 cannot be forced through the tooth assembly 10 in a direction from the first aligned passage 32 towards the second aligned passage 34. Consequently, the only way that the pin 40 can be removed from the tooth assembly 10 is in the direction from the second aligned opening 34 towards the first aligned opening 32.

In the event, the pin 40 attempts to move in a direction from the second aligned opening 34 towards the first aligned opening 32, the third conical spring washer 46 contacts the inside wall of the socket 30 of the ground engaging tool 14. Further attempts of movement in this direction results in the first, second, and third conical spring washers 42,44,46 being forced to change towards a shape that is flat. As the first, second, and third conical spring washers 42,44,46 are being flattened, the diameter of the inner surface 52 attempts to become smaller. As the diameter of the inner surface 52 is attempting to become smaller, a greater compressive force is applied to the respective angled ridges 66 thus further inhibiting the inner surface 52 from slipping over the respective shoulders 68. The subject arrangement can withstand a very high force without inadvertently becoming disassembled.

In order to remove the pin 40 from its assembled position, a force is applied to the end of the second portion 70 of the pin 40 adjacent the second aligned opening 34 to move the pin 40 in a direction from the second aligned opening 34 towards the first aligned opening 32. This external force must be sufficiently high to force the diameter of the openings 53 to expand in order for the inner surfaces 52 to slip over the shoulders 68 thereof. Once the first, second, and third conical spring washers have been forced to slip over the respective shoulders 68 and are in a position that the inner surface 52 is located around the second portion 70 of the pin 40, the pin 40 can easily be moved the remainder of the distance for disassembly.

Referring to the embodiment set forth in FIG. 4, the assembly of the hollow support member 76 and the first, second, and third conical spring washers 42,44,46 into the annular recess 22 and the subsequent mounting of the ground engaging tool 14 onto the nose portion 18 is the same as that set forth above with respect to FIGS. 1-3. The second portion 70 of the pin 40 of the subject embodiment is inserted into the first aligned opening 32 through the first, second, and third conical spring washers 42,44,46 and into the cross passage 20 until the larger first portion 62 thereof contacts the third conical spring washer 46 adjacent the inner surface 52 thereof. At this point, an external force is applied to the end of the first portion 62 of the pin 40 forcing it in a direction towards the second aligned opening 34. As the pin 40 is being forced in a direction towards the second aligned opening 34, the diameter of the inner surface 52 is being forced to expand to a larger diameter in order to slip over the predetermined diameter of the pin 40. In the subject embodiment, the predetermined diameter of the pin 40 is the outer diameter of the shoulder 68. The pin 40 is continually forced in the direction towards the second aligned opening 34 until the inner surface 52 of each of the first, second, and third conical spring washers 42,44,46 is located in the groove 64. As set forth above, with respect to FIGS. 1-3, the first, second, and third conical spring washers 42,44,46 are caused to flex as a result of the outer peripheral edge 54 of the first conical spring washer 42 being in contact with the angled second surface 82 of the hollow support member 76. This flexing of the first, second, and third conical spring washers 42,44,46 aid in the diameter of the openings 53 thereof expanding to a larger size. Once the inner surfaces 52 of the first, second, and third conical spring washers 42,44,46 are located in the groove 64, they return to their initial shape. In the subject embodiment, the diameter of the openings 53 are larger than the diameter of the groove 64, thus the first, second, and third conical spring washers 42,44,46 are not under any type of load. Since the diameter of the first portion 62 of the pin 40 is greater than the diameter of the cross passage 20 of the nose portion 18, the pin 40 cannot be removed in a direction extending from the first aligned opening 32 towards the second aligned opening 34. Any attempts of the pin 40 inadvertently becoming disassembled in the opposite direction is resisted when the concave side 48 of the third conical spring washer 46 contacts the inside surface of the socket 30 of the ground engaging tool 14. Since the first, second, and third conical spring washers 42,44,46 are progressively flattened during any further movement towards disassembly of the pin 40 and the diameter of the inner surface 52 becomes smaller as a result thereof, the subject arrangement can withstand high forces resisting any attempt of inadvertent disassembly.

In order to remove the pin 40 from the disassembled position, an external force is applied to the end of the second portion 70 of the pin 40 located adjacent the second aligned opening 34 moving the pin 40 in a direction from the second aligned opening 34 towards the first aligned opening 32. The force must be sufficiently high in order to force the diameter of the openings 53 of the respective first, second, and third conical spring washers 42,44,46 to expand so that the respective inner surfaces 52 can slip over the shoulder 68. Once the pin 40 has been moved in a direction far enough for the first, second, and third conical spring washers 42,44,46 to be located around the second portion 70 of the pin 40, the pin 40 may be easily removed thereafter. Referring to the embodiment of FIG. 5, the assembly of the hollow support member 76, the first, second, and third conical spring washers 42,44,46, and the ground engaging tool 14 are the same as set forth in the previous embodiments. In this arrangement, the first portion 62 and the second portion 70 of the pin 40 have the same diameter which is the same as the predetermined diameter of the pin 40. In the subject embodiment, the second portion 70 of the pin 40 is inserted into the first aligned opening 32 until the end of the second portion 70 of the pin 40 contacts the third conical spring washer 46 adjacent the inner surface 52 thereof. An external force is applied to the end of the first portion 62 forcing the first, second, and third conical spring washers 42,44,46 to flex in the same manner as set forth in the previous embodiments until the diameter of the respective openings 53 thereof are increased to a size sufficient for the predetermined diameter of the pin 40 to slip therethrough. The external force is continually applied forcing the pin 40 in a direction towards the second aligned opening 34 until the inner surfaces 52 of the first, second, and third conical spring washers 42,44,46 are located in the groove 64 thereof. As noted with respect to FIG. 4, the diameter of the openings 53 of the first, second, and third conical spring washers 42,44,46 is larger than the diameter of the groove 64. Consequently, once assembled, the first, second, and third conical spring washers 42,44,46 are in their relaxed condition.

As set forth above, any movement of the pin 40 in a direction from the second aligned opening 34 towards the first aligned opening 32 is resisted by the contact of the third conical spring washer 46 against the inside wall of the socket 30 of the ground engaging tool 14. However, in the subject embodiment, since the diameters of the first portion 62 and the second portion 70 are the same, the pin 40 can move in a direction from the first aligned opening 32 towards the second aligned opening 34. Consequently, a force equal to the assembly force can be applied to remove the pin 40 in a direction towards the second aligned opening 34. Once the pin 40 is fully removed from the first, second, and third conical spring washers 42,44,46, the pin may be easily pulled from the assembly. Conversely, any attempts to remove the pin 40 from the same side that it was installed results in the force being resisted in the same manner as noted with respect to the embodiment of FIG. 4. Even though the removal force could be the same as the assembly force, the assembly force is sufficiently high so that this arrangement could be satisfactorily used in many applications where extremely large external forces trying to remove the pin 40 are absent.

Referring now to FIG. 6, the assembly of the hollow support 76, the first, second, and third conical spring washers 42,44,46 and the ground engaging tool 14 are the same as same as set forth in the previous embodiments. In the subject embodiment, the second portion 70 of the pin 40 is inserted through the first aligned opening 32, the first, second, and third conical spring washers 42,44,46 and into the cross passage 20 until the larger first portion 62 thereof contacts the third conical spring washer 46 adjacent the inner surface 52 thereof. The diameter of the openings 53 of the first, second, and third conical spring washers 42,44,46 are forced to expand in the same manner as set forth in the previous embodiments. The external force is continually applied until the inner surfaces 52 of the first, second, and third spring washers 42,44,46 are located in the groove 64. Once the inner surfaces 52 are located in the groove 64, the conical spring washers 42,44,46 return to their fully relaxed condition as previously set forth in the above noted embodiments. Since the diameter of the first portion 62 of the pin 40 is greater than the diameter of the cross passage 20, the pin 40 cannot be disassembled in a direction from the first aligned opening 32 towards the second aligned opening 34.

As previously noted with respect to previous embodiments, inadvertent attempts of the pin 40 to come out during use is strongly resisted. In order to remove the pin 40 from its assembled position, a force is applied to the end of the second portion 70 of the pin 40 forcing the diameter of the respective openings 53 of the first, second, and third conical spring washers 42,44,46 to expand until the respective inner surfaces 52 slip over the shoulder 68. Once the pin 40 has been moved to a position that the first, second, and third conical spring washers 42,44,46 are disposed around the second portion 70, the pin 40 can be easily removed.

Referring now to the embodiment set forth in FIG. 7, the assembly of the components is quite similar to that set forth in the previous embodiments. However, in the subject arrangement, there is no hollow support member 76 to insert into the annular recess 22 since the structure of the nose portion 18 has an angled surface 90 integrally formed therein. The first, second, and third conical spring washers 42,44,46 are inserted in the annular recess 22, in the same manner previously set forth, followed by placement of the ground engaging tool 14 over the nose portion 18. The pin 40 is inserted into the first aligned opening 32 through the first, second, and third conical spring washers 42,44,46 and into the cross passage 20 until the enlarged portion 88 of the pin 40 contacts the concave surface 48 of the third conical spring washer 46 adjacent the inner surface 52 thereof. An external force is applied to the end of the pin 40 forcing it in a direction towards the second aligned opening 34. The first, second, and third conical spring washers 42,44,46 are forced to flex in the same manner as set forth in the previous embodiments. The only difference being that the outer peripheral edge 54 of the first conical spring washer 42 is in contact with the angled surface 90 as opposed to the angled surface 82 of the hollow support member 76. Once the shoulder 68 formed by the intersection of the enlarged portion 88 and the predetermined diameter of the pin 40 passes through the openings 53 of the first, second, and third conical spring washers 42,44,46, each of the first, second, and third conical spring washers 42,44,46 return to their relaxed condition. Since the enlarged portion 88 of the pin 40 has a diameter greater than the diameter of the cross passage 20, the pin 40 cannot be removed in a direction towards the second aligned opening 34. Any attempts, during use, of the pin 40 trying to inadvertently come out in a direction from the second aligned opening 34 towards the first aligned opening 32 is resisted once the concave surface 48 of the third conical spring washer 46 contacts the inner surface of the socket 30 of the ground engaging tool 14. Further movement of the pin 40 in the direction of the first aligned opening 32, as set forth in previous embodiments, causes the first, second, and third conical spring washers 42,44,46 to flatten, thus resulting in the diameter of the inner surface 32 becoming smaller.

In order to disassemble the pin 40 from its assembled position, a force is applied to the pin 40 at a location adjacent the second aligned opening 34 forcing the pin 40 in a direction towards the first aligned opening 32. The high force is applied in order to force the diameter of the openings 53 of the first, second, and third conical spring washers 42,44,46, to expand to a size sufficient for the respective inner surfaces 52 to slip over the outer diameter of the shoulder 68. Once the enlarged portion 88 passes through the respective first, second, and third conical spring washers 42,44,46, the pin 40 can be easily removed.

In the embodiments set forth above, the respective pins 40 are made from an SAE 4140 material heat treated to a hardness of Rockwell "C" 40–44. This material has a yield strength in the range of 1,120 to 1,290 MPa (162,000–187,000 psi), and a modulus of elasticity of 200,000 MPa (29,000,000 psi). The first, second, and third conical spring washers 42,44,46 are made from a spring steel material having a carbon content in the range of 0.55–1.05 and is heat treated to a hardness of Rockwell "C" 48–52. This material has a yield strength in the range of 1,470 MPa–1,690 MPa (213,000–246,000 psi) and a modulus of elasticity approximately the same as the material of the pin 40.

The following set forth one example of the forces needed to assemble and disassemble at least one arrangement of the embodiments set forth above. The test of the example was conducted on the arrangement illustrated in FIG. 7. The outer diameter of the enlarged portion 88 which is the same as the outer diameter of the shoulder 68 is 35 millimeters (1.377 inches) and the diameter of the openings 53 defined by the inner surfaces 52 of the first, second, and third conical spring washers 42,44,46 is 33.83 millimeters (1.332 inches). In the subject test, a force of approximately 40.72 kN (9,150 pounds) was used to assemble the pin 40. A force of approximately 105.02 kN (23,600 pounds) was used to disassemble the pin 40. It is recognized that the forces necessary to assemble and disassemble the components will vary as the sizes of the pin 40 and the conical washers 42,44,46 varies. Naturally, tooth assemblies 10 that are small may require a smaller pin 40 and smaller conical spring washers 42,44,46, and tooth assemblies that are larger may likewise require a larger pin 40 and larger conical spring washers 42,44,46. Furthermore, a greater number or lesser number of conical spring washers may be used depending on design criteria.

In view of the foregoing, it is readily apparent that the structure of the present invention provides a retaining mechanism 16 that can insure that, during use, the pin 40 is readily secured in its assembled position. Furthermore, the components can be assembled and disassembled without having to shear or fracture any of the components. It is recognized that in some instances the conical spring washers 42,44,46 may crack or fracture during disassembly thereof.

Other aspects, objects, and advantages of this invention can be obtained from a study of the drawings, the disclosure, and the appended claims.

I claim:

1. A retaining mechanism adapted for use in securing a ground engaging tool to a work implement, the ground engaging tool having a rearward end portion defining a socket and first and second aligned openings defined in the rearward end portion and located on opposite sides of the socket, the work implement having a nose portion adapted to mate with the socket and defining a cross passage that registers, when assembled, with the first and second aligned openings and an annular recess having a bottom surface and being defined in the nose portion or in the rearward end portion concentric with the cross passage or the first and second aligned openings, the retaining mechanism, comprising:

a conical spring washer having a concave side, a convex side, and an inner surface defining an opening of a predetermined diameter, and being located, when assembled, in the annular recess; and a pin having a predetermined diameter and including means for forming a shoulder thereon having a diameter larger than the diameter of the opening of the conical spring washer, the pin being located, when assembled, in the first and second aligned openings, the cross passage, and the opening of the conical spring washer with the shoulder means being located adjacent the convex side of the conical spring washer.

2. The retaining mechanism of claim 1 wherein the shoulder means includes a shoulder having an outer diameter and the outer diameter of the shoulder is in the range of approximately 2 to 5 percent greater than the predetermined diameter of the opening of the conical spring washer.

3. The retaining mechanism of claim 2 wherein the outer diameter of the shoulder is more specifically in the range of 3 to 4 percent greater than the predetermined diameter of the opening of the conical spring washer.

4. The retaining mechanism of claim 3 wherein the conical spring washer has an outer peripheral edge on the convex side thereof and the retaining mechanism includes means for supporting the outer peripheral edge of the conical spring washer, during assembly, the supporting means is located in the annular recess.

5. The retaining mechanism of claim 4 including a second conical spring washer having a concave side, a convex side, and an inner surface defining an opening of a predetermined diameter, and being located, when assembled, in the annular recess with the convex side thereof adjacent the concave side of the first conical spring washer.

6. The retaining mechanism of claim 5 including a third conical spring washer having a concave side, a convex side, and an inner surface defining an opening of a predetermined diameter, and being located, when assembled, in the annular recess with the convex side thereof adjacent the concave side of the second conical spring washer.

7. The retaining mechanism of claim 6 wherein each of the conical spring washers are substantially identical in size and shape.

8. The retaining mechanism of claim 7 wherein the means for forming a shoulder includes a groove defined in the pin around the circumference thereof generally adjacent one end thereof, the diameter defined by the groove being smaller than the predetermined diameter of the opening of the first, second, and third conical spring washers, and the predetermined diameter of the pin being greater than the predetermined diameter of the respective opening of the first, second, and third conical spring washers.

9. The retaining mechanism of claim 8 wherein the shoulder is defined by one side of the groove in the pin.

10. The retaining mechanism of claim 9 wherein a first portion of the pin has a diameter the same size as the predetermined diameter, and a second portion of the pin has a smaller diameter and the second portion being adapted, when assembled, to be located in the cross passage of the nose portion and the second opening of the aligned openings, and the first portion of the pin, when assembled, is located in the first opening of the aligned openings and the annular recess of the nose portion.

11. The retaining mechanism of claim 10 wherein, when assembled, the convex side of each conical spring washer is facing towards the second portion of the pin.

12. The retaining mechanism of claim 11 wherein the pin has a longitudinal axis and the groove defined in the pin defines a plurality of individual adjacent ridges one for each of the first, second, and third conical spring washers, each ridge is angled with respect to the longitudinal axis of the pin and each ridge defines a shoulder.

13. The retaining mechanism of claim 12 wherein a bottom surface is defined by the annular recess, the support means includes a hollow support member having a longitudinal axis, a first surface perpendicular to the longitudinal axis and operative, when assembled, to abut the bottom surface of the annular recess, and a second surface angled with respect to the longitudinal axis of the hollow support member and operative, during assembly, to contact the outer peripheral edge of the first conical spring washers.

14. The retaining mechanism of claim 13 wherein the second surface has an angle of generally 45 degrees with respect to the longitudinal axis of the support member.

15. The retaining mechanism of claim 11 wherein the second portion of the pin has a longitudinal axis offset with respect to the longitudinal axis of the first portion of the pin.

16. The retaining mechanism of claim 15 wherein the offset of the first and second portions of the pin results in the outer surface of each being in axial alignment at one point on their respective circumferences.

17. The retaining mechanism of claim 7 wherein the shoulder of the means for forming a shoulder is formed by the intersection of an enlarged portion and the portion of the pin having the predetermined diameter, and the enlarged portion of the pin is located, when assembled, in the annular recess between the cross passage and the first conical spring washer.

18. The retaining mechanism of claim 17 wherein the diameter of the enlarged portion of the pin is larger than the diameter of the cross passage.

19. The retaining mechanism of claim 18 wherein, when assembled, the convex side of each conical spring washer is facing towards the enlarged portion of the pin.

20. The retaining mechanism of claim 19 wherein the support means includes an angled surface formed in the annular recess of the nose portion adjacent the bottom surface thereof operative, during assembly, to contact the outer peripheral edge of the first conical spring washer.

21. A tooth assembly comprising:

a ground engaging tool having a rearward end portion defining a socket and first and second aligned openings defined therein and located on opposite sides of the socket;

a work implement having a nose portion operative to mate with the socket of the ground engaging tool, a cross passage defined in the nose portion that is generally in axial alignment with the first and second aligned openings, and an annular recess defined in one side of the nose portion concentric with the cross passage, and a retaining mechanism including a conical spring washer having a concave side, a convex side, an outer peripheral edge on the convex side, and an inner surface defining an opening of a predetermined diameter, and a pin having a predetermined diameter and including means for forming a shoulder thereon having a diameter larger than the diameter of the opening of the conical spring washer, the conical spring washer being located in the annular recess and the pin being disposed in the first and second aligned openings, the cross passage, and the conical spring washer with the shoulder means being located adjacent the convex side of the conical spring washer.

22. The tooth assembly of claim 21 including means for supporting, during assembly, the outer peripheral edge of the conical spring washer, the support means being located in the annular recess.

23. The tooth assembly of claim 22 wherein a bottom surface is defined in the nose portion at bottom of the annular recess, the support means includes a hollow support member having a longitudinal axis, a first surface perpendicular to the longitudinal axis thereof and being in abutment with the bottom surface of the annular recess and a second surface angled with respect to the longitudinal axis thereof and operative, during assembly, to contact the outer peripheral edge of the conical spring washer.

24. The tooth assembly of claim 22 wherein the support means is integrally formed in the annular recess and has a surface, adjacent the bottom surface thereof, angled with respect to the longitudinal axis of the cross passage.

25. The tooth assembly of claim 24 wherein the angled surface has an angle of generally 45 degrees with respect to the longitudinal axis of the cross passage.

* * * * *